US005172174A

United States Patent [19]

Fuma et al.

[11] Patent Number: 5,172,174

[45] Date of Patent: Dec. 15, 1992

[54] TRANSFER DEVICE WITH INSULATED SHIELD

[75] Inventors: Hiroshi Fuma; Mitsuo Motohashi; Yozo Fujii; Akihiko Kakita, all of Hachioji, Japan

[73] Assignee: Konica Corporation, Tokyo, Japan

[21] Appl. No.: 612,839

[22] Filed: Nov. 9, 1990

[30] Foreign Application Priority Data

Nov. 14, 1989 [JP] Japan ..... 1-295276
Dec. 6, 1989 [JP] Japan ..... 1-317062
Dec. 7, 1989 [JP] Japan ..... 1-318507

[51] Int. Cl.[5] ..... G03G 15/16
[52] U.S. Cl. ..... 355/275
[58] Field of Search ..... 355/208, 216, 217, 219, 355/221, 223, 271, 274, 275, 276, 277; 250/324, 325, 326

[56] References Cited

U.S. PATENT DOCUMENTS 3,357,325 12/1967 Eichorn et al. ..... 355/315 X
3,697,170 10/1972 Bhagat et al. ..... 355/274 X
3,966,199 6/1976 Silverberg ..... 271/275
4,050,802 9/1977 Tanaka et al. ..... 355/215
4,258,258 3/1981 Laing et al. ..... 250/324
4,407,580 10/1983 Hashimoto et al. ..... 355/275

*Primary Examiner*—A. T. Grimley
*Assistant Examiner*—Christopher Horgan
*Attorney, Agent, or Firm*—Frishauf, Holtz, Goodman & Woodward

[57] ABSTRACT

A transfer belt unit for conveying a recording sheet on a conveyor thereof and transferring a toner image from the surface of an image carrying drum to the recording sheet by electrostatic charging of the recording sheet and the conveyor belt by a corona discharger located on the rear side of the conveyor belt at a contact location of the image carrying drum and the conveyor belt. The transfer belt unit is provided with a preliminary corona discharger located in the wedge shaped space between the surfaces of the conveyor belt and the image carrying drum for charging the conveyor belt and the recording sheet by corona discharging to attract the recording sheet to the surface of the conveyor belt by electrostatic force. The preliminary discharger is composed of an electrode for corona discharging and a shield plate with an opening for restricting a discharging zone from the electrode to the recording sheet.

12 Claims, 7 Drawing Sheets

TRANSFER DEVICE WITH INSULATED SHIELD

BACKGROUND OF THE INVENTION

This invention relates to a transfer belt unit for conceiving a recording paper and transferring a toner image on the surface of an image carrying member onto the recording paper by a physical means, and further conveying the recording paper to a fixing unit after the transfer of the toner image.

FIG. 3 is a sectional schematic view showing an embodiment of a conventional electrophotographic copying machine. In the figure, numeral 10 indicates a photosensitive drum which is a drum-shaped image carrying member, 20 a charging unit for charging the peripheral surface of the photosensitive drum 10, 30 an exposure unit, 13 an image exposure unit, 40 a developing unit, 50 a transfer material feed unit, 79 a paper feed roller, P a recording paper which is a transfer material, 16 a transfer unit which is a charging unit for transferring images, 17 a separation unit which is a static eliminator for separation, 80 a fixing unit, 90 a cleaning unit, and 56 a conveyor belt which is a conveying means of the recording paper P.

The operation of the above copying machine will be described hereunder. The peripheral surface of the photosensitive drum 10 is uniformly charged by the charging unit 20, and the peripheral surface of the photosensitive drum 10 is exposed at the image exposure location 13 by the exposure unit 30 to form an electrostatic latent image. The latent image is developed and visualized as a toner image by the developing unit 40. The toner image is transferred onto the recording paper P which is timely fed by paper feed rollers 79 of the paper feed unit 50. During transfer, the recording paper is charged reverse in sign to toner charge by corona discharging of the transfer unit 16 located behind the conveyor belt. After transfer, AC high voltage is applied to the separation unit 17 to eliminate the charge on the recording paper P to separate it from the photosensitive drum 10. The separated recording paper P is conveyed to the fixing unit 80 by the conveyor belt 56, and the toner image is fixed and ejected from the unit.

Residual toner on the peripheral surface of the photosensitive drum 10 which transfers the toner image is removed by the cleaning unit 90, and the drum waits for the next copy.

However, the above configuration requires adjustment of the discharge efficiency between the transfer unit 16 and the separation unit 17 for best performance to ensure transfer and separation of a toner image. Furthermore, the discharge efficiency is greatly affected by the environment and the tolerable range for reliability is narrow. The image transferability is affected by the charge and mechanical characteristics (such as stiffness, surface smoothness, curl) of the recording paper P. They vary greatly with the storage condition of the recording paper P including the environmental condition (temperature, humidity, etc.), and it is difficult to always keep them suitable.

When the photosensitive drum 10 is large in diameter, the force that the recording paper P, which is wound round the photosensitive drum 10, will be returned to the original flat state is smaller than that when the drum diameter is small. Therefore, the recording paper P, which finishes toner image transfer, is adhered straight to the photosensitive drum 10, causing paper jamming.

As a result, the paper feeding facility as a machine is decreased and the reliabilty is lowered.

A belt-shaped transfer and conveying unit, which eliminates the above defects, shown in FIG. 4 is indicated in U.S. Pat. No. 3,357,325 or others.

In FIG. 4, numeral 10 indicates a photosensitive drum which is a drum-shaped image carrying member, 79 paper feed rollers of the paper feed unit, **70*a* a transfer belt unit which is a belt-shaped transfer and conveying unit, 71 a transfer belt which is a dielectric single layer belt, 72 and 73 rollers which stretches the transfer belt 71, therebetween, 60 a corona discharger for charging the recording paper by corona discharge to electrostatically hold the recording paper P onto the transfer belt 71, 16 a transfer unit which charges a toner image from the back of the transfer belt 71 to transfer the image to the recording paper P from the photosensitive drum and 160 a transfer section. This configuration allows the recording paper P to be securely adhered to the transfer belt 71** for conveying and provides an improved transfer efficiency and separation efficiency.

The above transfer belt unit **70*a* is extremely suited to a color image forming device which superimposes toner images on the photosensitive drum 10 and transfers them onto the recording paper P at a time. In the above color image forming device, since toner images are superimposed on the photosensitive drum 10**, a plurality of developing units are installed and the drum diameter is large. Therefore, the conventional electrostatic transfer separation method cannot produce a sufficient separation efficiency, and hence a high separation efficiency is required. When toner images are superimposed, the amount of adhered toner is increased and a large transfer charge is required. Therefore, a high transfer charge holding capability is required. The transfer belt unit is excellent in these two points.

FIRST OBJECT OF THE INVENTION

In the transfer conveying unit (transfer belt unit) shown in FIG. 4, the recording paper P and the transfer belt 71 are charged by the corona discharger 60 and attract each other, and hence the recording paper P is conveyed as the transfer belt 71 moves. When the ambient humidity is high, however, the charge leaks greatly during conveying and the attraction decreases, causing unstable conveying.

To solve this problem, it is desirable to install the corona discharger 60 near the transfer section 160. The space near the transfer section 160, however, has a wedge section shape which is formed by the photosensitive drum 10 and the transfer belt 71. Since the discharge wires of the corona discharger 60 are applied with a high voltage from 5 to 7 kV, the distance between the discharge wires and the back plate which is a shielding member is required to be 6 or 7 mm or more. Therefore, it is difficult to make the conventional corona discharger 60 smaller. There is a fixed limitation on it, and the corona discharger is inevitably installed at a certain distance from the transfer section 160, and the above problem cannot be solved.

The first object of the present invention is to solve the above problem and provide a transfer belt unit having superior conveyability and separability.

SECOND OBJECT OF THE INVENTION

In the transfer belt unit **70*a* shown in FIG. 4, to obtain satisfactory separability such that the recording paper P is securely attracted to and conveyed by the transfer belt 71 after toner image transfer, it is desirable that the head of the recording paper P is sufficiently charged to be securely attracted to the transfer belt 71. For that purpose, it is required that the head of the recording paper P is tightly contact the transfer belt 71 when the head portion enters the effective discharge region of the corona discharger 60. This is because when the recording paper P is farther away from the grounded portion (the roller 72** in this example), the potential of the recording paper P increases in great amount with a small amount of electric charge, and so the head of the recording paper is not sufficiently charged.

The second object of the present invention is to solve the above problem and provide an image forming device with a transfer belt unit having superior conveyability and separability.

SUMMARY OF THE INVENTION

The first object is accomplished by a transfer belt unit which is characterized in that a corona discharger is installed in a wedge-shaped space formed by an image carrying member and a belt unit so that the opening thereof is opposite to the belt.

The first object is accomplished by a transfer belt unit which is characterized in that the inner side of the back plate of the corona discharger, which is opposite to the discharge wires and is closest to the image carrying member, is covered with an insulating layer, and the shortest distance between the back plate surface covered with an insulating layer and the discharge wires is shorter than the spark air gap to cause insulation breakage when the insulator layer is not provided.

The second object is accomplished by an image forming device which comprises a transfer belt, which is stretched between rollers and rotates, a corona discharger, and a charging unit, and transfers toner images on an image carrying member onto a recording paper which is conveyed by a paper feed means, characterized in that the contact point of a tangent line drawn from the end of the paper feed means to the transfer belt of the rollers is within the effective discharge region of the corona discharger and the prolonged line of the paper feed means in the paper feed path direction leans downward much more than the above tangent line.

DETAILED DESCRIPTION OF THE INVENTION

Figure 1:
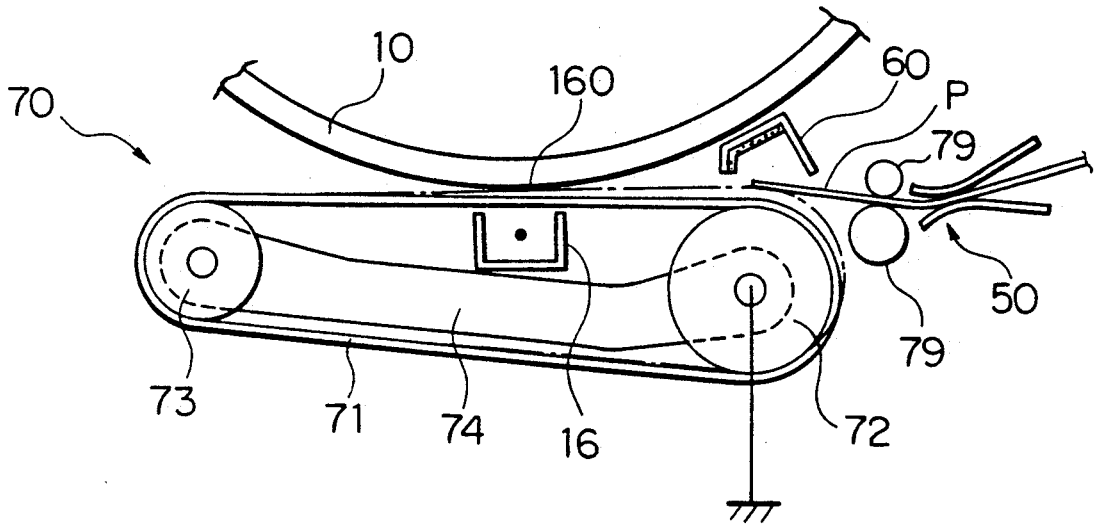
FIG. 1 is a schematic view of an embodiment of a transfer belt unit of the present invention.
Figure 4:
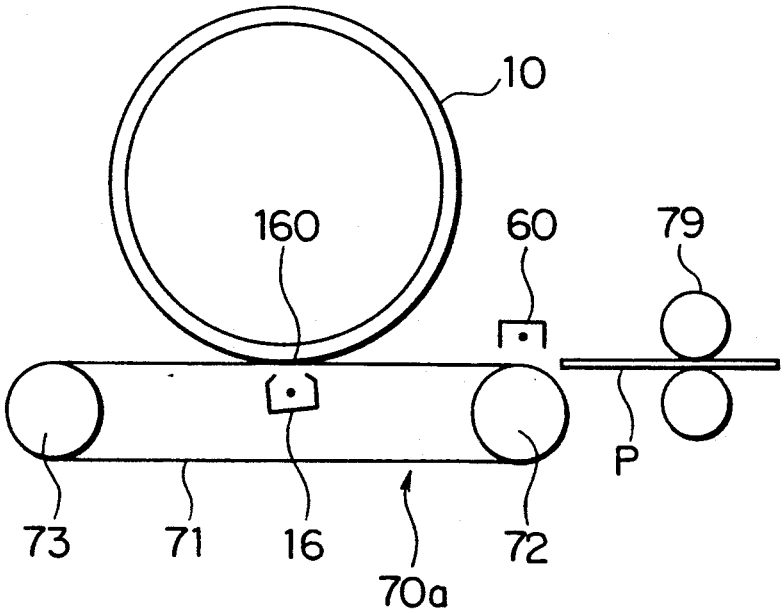
FIG. 4 is a schematic view showing an embodiment of a conventional transfer belt unit.

FIG. 1 is a schematic view of the first embodiment of a transfer belt unit of the present invention. The parts in the figure which are the same as those of a conventional transfer belt unit 70*a* shown in FIG. 4 are expressed by the same numerals, and duplicated detailed descriptions thereof are omitted because the operations thereof are almost similar. Rollers 72 and 73 are made of a conductive metallic material, and the roller 72 on the upper stream side is grounded or provided with a predetermined potential close to the grounded status. Numeral 74 indicates a roller support member. One end thereof is connected to the shaft center (fixed shaft) of the roller 73 and the other end to the moving shaft of the roller 72, and the support is forced by an elastic member which is not shown in the figure so that the roller 72 is positioned down. Therefore, the transfer belt 71 is kept away from the peripheral surface of the photosensitive drum 10 in the normal state. During image transfer, the roller support member 74 is rotated counterclockwise, for example, by a solenoid which is operated under control of the equipment control unit, and the transfer belt 71 is pressed against the photosensitive drum 10 at a predetermined pressure.

Figure 2:
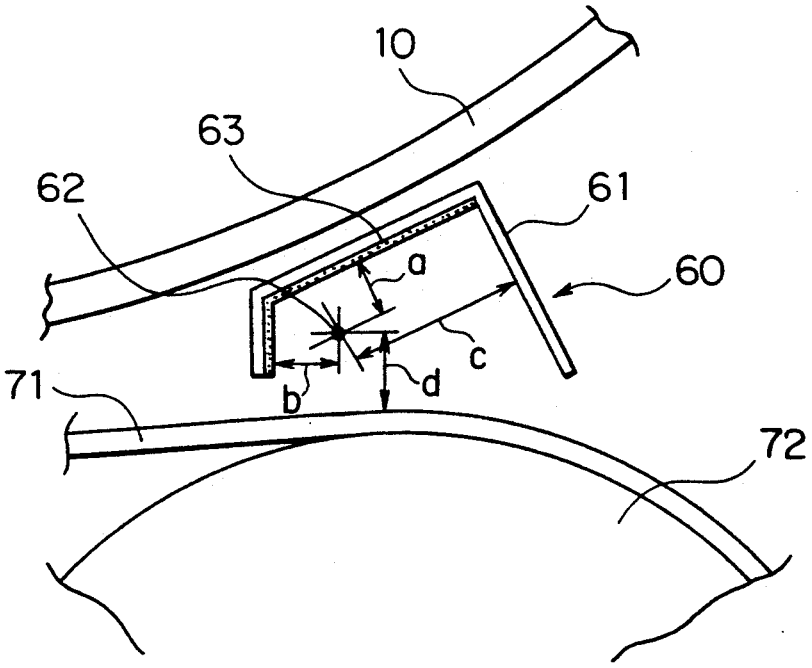
FIG. 2 is an enlarged sectional view showing the transfer section and its vicinity shown in FIG. 1.

FIG. 2 is an enlarged sectional view showing the transfer section and its vicinity shown in FIG. 1. In the figure, numeral 61 indicates a back plate of the corona discharger 60 which is a shielding plate comprising a stainless steel plate, galvanized steel plate, or aluminum plate, and 62 discharge wires comprising tungsten wires 60 to 100 microns in diameter. The back plate 61 produces an effect that the corona discharge is stabilized by forming a stable electric field during charging by the corona discharger 60. During charging, the discharge wires 62 are applied with 5 to 7 kV. If the distance between the discharge wires 62 and the bare back plate 61 is less than about 6 mm, a spark discharge may occur between the discharge wires 62 and the back plate 61, causing no charging to the open part and damage to the power source. The present invention forms an insulating layer on the inner wall of the back plate 61 on the photosensitive drum 10 side by attaching, for example, a polyester resin tape to prevent a spark discharge when the discharge wires 62 come near the back plate 61. The back plate 61 has, for example, an L-shaped section as shown in FIG. 2 so that it is suited to an installation space with a triangular section. The distances "a" and "b" between the discharge wires 62 and the inner walls of the back plate 61 on the photosensitive drum 10 side are 4 mm, the distance c between the discharge wires and the inner wall of the back plate on the opposite side is 8 mm, and the distance d between the discharge wires and the transfer belt 71 is 6 mm. The corona discharger 60 of the transfer belt unit 70 of the present invention is made smaller under the above configuration and wedge-shaped or generally trapezium-shaped, as seen in FIG. 2, so that it is suited to a triangular space where it is to be installed. By doing this, the corona discharger can be installed extremely close to the transfer section 160.

The corona discharger 60 is installed opposite to the roller 72, discharges corona to the recording paper P fed by a transfer material feed unit 50, and charges the recording paper efficiently and surely using the roller 72, which is almost in the grounded state, as an opposite electrode. Furthermore, since the distance between the corona discharger and the transfer section 160 can be extremely shortened, the transfer belt 71 can securely hold and convey the recording paper P, and the separability of the recording paper P from the photosensitive drum 10 after image transfer can be always kept satisfactory.

The transfer belt 71 used as a transfer means comprises, for example, two layers; that is, the base layer thereof is a silicone rubber, polyurethane rubber, or butyl rubber endless sheet with a thickness of 0.5 to 1 mm and a volume resistivity of about $10^{10}$ ohm.cm (high) and the upper layer thereof is a fluorocarbon resin film which is sprayed on the base layer to decrease the abrasion resistance.

When the recording paper P is charged by corona discharge of the corona discharger 60, the transfer belt 71 is induced with reversed charges and the recording paper P is closely adhered to the transfer belt 71. The electrode of the corona discharger 60 is applied with a high voltage with the same polarity as that of the toner (developer) to charge the recording paper P with the same polarity as that of the toner. Therefore, the toner on the photosensitive drum 10 is not attracted by the recording paper P before the recording paper P reaches the transfer section 160, providing clearly copied image quality.

The above applied high voltage is subject to constant current control so that a discharge current of 20 to 50 μA is obtained when the moving linear velocity of the peripheral surface of the photosensitive drum 10 is 140 mm/sec. In this case, the current component running in the direction of the recording paper P is 10 to 20 μA when the humidity is high or 5 to 10 μA when the humidity is low.

The electrode of the transfer charging unit 16 is applied with a high voltage with a polarity reverse to that of the toner charge under the constant current control after the top frame of the recording paper P passes through the transfer section to transfer the toner image. This constant current control switches the current to 350 μA when the humidity is low or to 200 μA when the humidity is high to apply 5 to 7 kV. As a result, the head of the recording paper P is securely attracted to the transfer belt 71 after image transfer, and the separability after transfer is kept satisfactory, free of paper jamming due to attraction of the photosensitive drum 10.

By doing this, the charge current can be varied according to a change of the humidity which produces a great effect so as to keep a fixed range of attraction and transfer efficiency, and an attraction and conveying force, which is always kept constant and secure without being affected by the environment, and a high transfer efficiency can be obtained, and the recording paper can be smoothly conveyed.

Figure 5:
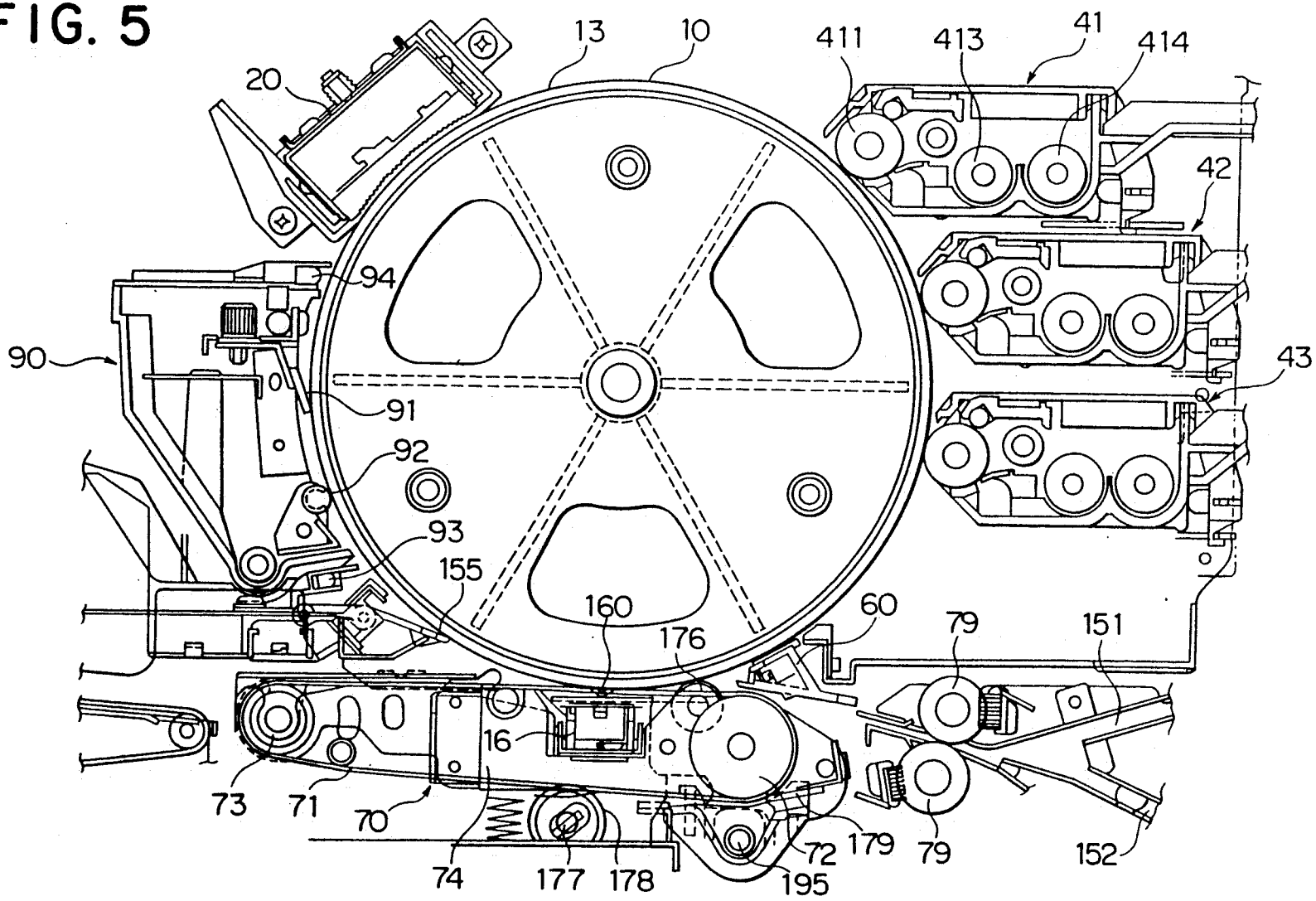
FIG. 5 is a sectional schematic view of an embodiment of a color image forming device of the present invention.

FIG. 5 is a sectional schematic view of an embodiment applied to a color image forming device of the present invention.

In the figure, numeral 10 indicates a drum-shaped image carrier member, or a photosensitive drum, which is a drum coated with an OPC photoconductor and grounded so that it rotates clockwise. Numeral 20 indicates a scorotron charging unit for charging the photoconductor on the peripheral surface of the photosensitive drum 10, and 13 an image exposure unit where an image exposure light or laser beam is irradiated so as to be focused on the peripheral surface of the photosensitive drum 10 by an exposure optical system which is not shown in the figure.

A laser write unit, for example, is used as an exposure optical system. When a color signal outputted from an image reading unit which is different from the foregoing image forming device is supplied to the laser write unit, a laser beam (a wavelength of 780 nm) generated from a semiconductor laser is rotationally scanned by a polygon mirror of the laser write unit, bent its path by a reflection mirror via a fO lens, and irradiated to the peripheral surface of the photosensitive drum 10 which is uniformly charged by the charging unit 20.

When the scanning is started, the laser beam is detected by an index sensor and modulated by the first color signal, and the modulated laser beam scans the peripheral surface of the photosensitive drum 10. As a result, a latent image for the first color is formed in the image section on the photosensitive drum 10 by the main scanning by the laser beam and the sub-scanning by the rotation of the photosensitive drum 10. This latent image is reversely developed by a developing means containing, for example, a yellow (Y) toner as a first color to form a yellow toner image on the peripheral surface of the photosensitive drum 10. The obtained toner image, which is retained on the peripheral surface of the photosensitive drum 10, in the image section passes under the transfer means and the cleaning means away from the peripheral surface of the photosensitive drum 10 and goes to the next copy process.

The photosensitive drum 10 is recharged by the charging unit 20, the second color signal outputted from the signal processing unit is supplied to the laser write unit, and a latent image is formed on the peripheral surface of the photosensitive drum 10 by writing by the second color signal in the same way as with the first color signal. This latent image is reversely developed by a developing means containing, for example, a magenta (M) toner as a second color to form a magenta toner image. This magenta toner image is superimposed on the yellow toner image which is previously formed. As a result, the magenta toner is partially overlaid on the yellow toner.

The obtained toner image, which is retained on the peripheral surface of the photosensitive drum 10, in the image section passes under the transfer means and the cleaning means away from the peripheral surface of the photosensitive drum 10 and goes to the next copy process.

In the same way, a latent image is formed on the photosensitive drum 10 by writing by the third color signal. This latent image is reversely developed by a developing means containing, for example, a cyan (C) toner as a third color. This cyan toner image is superimposed on the yellow and magenta toner images to obtain a color image. By using a developing means containing a black toner, a black toner image may be superimposed on the above color image to obtain a high quality color image.

Numerals 41, 42, and 43 indicate developing units containing yellow, magenta, and cyan toners respectively for performing the above development. The developing units are similarly structured.

Figure 6:
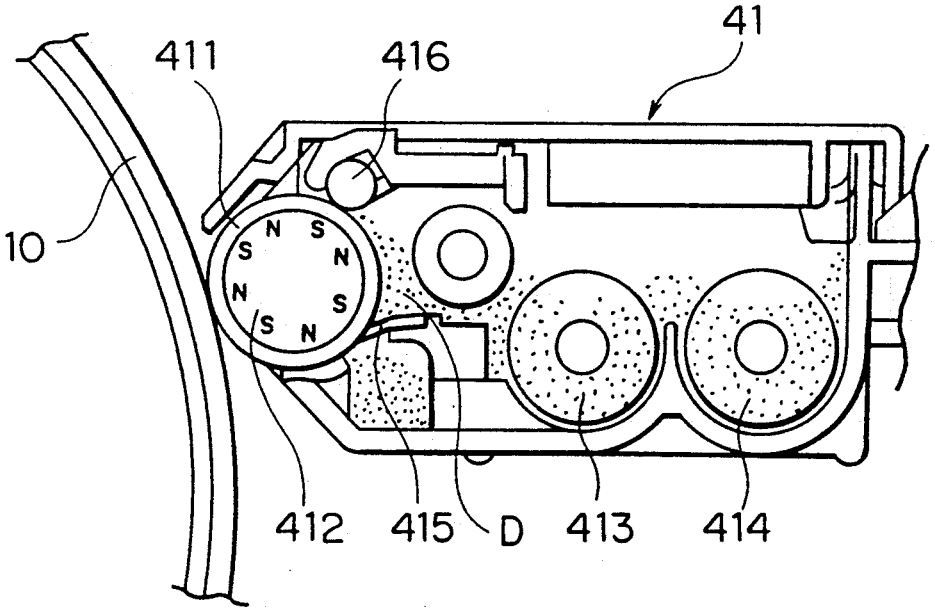
FIG. 6 is a sectional schematic view of the developing unit shown in FIG. 5.

FIG. 6 shows the structure of the developing unit 41, which contains a developing sleeve 411, a magnet roller 412, stirring screws 413 and 424, and a scraping plate 415. The distance between the developing sleeve 411 and the photosensitive drum 10 is always kept to about 0.5 mm by a roller (not shown in the figure) which touches outside the image section of the peripheral surface of the photosensitive drum 10 which is coaxially with the developing sleeve 411.

A toner fed from a toner container, which is not shown in the figure, is thoroughly stirred and mixed with a magnetic carrier by the stirring screws 414 and 413 which rotate in the opposite directions to each other. This 2-component developer D comprising the magnetic carrier and toner is fed to the developing sleeve 411 after stirring and mixing. The developing sleeve 411 contains a magnet roller 412 with the magnetic poles fixed, and a thin layer of the developer D is formed by the developing sleeve 411 and the magnet roller 412.

The thickness of a thin layer of developer D on the surface of the developing sleeve 411 can be controlled uniformly to about 300 microns by pressing a developer thin layer forming means 416, which is a cylindrical bar comprising a magnetic material installed, for example, opposite to the magnetic pole of the magnet roller 412, against the developing sleeve 411. The developing sleeve 411 is applied with a developing bias voltage to develop a latent image in the image section of the photosensitive drum 10. The developer D thin layer developed on the developing sleeve 411 is scraped off by the scraping plate 415 and then a new developer D thin layer is formed by the foregoing procedure.

The processing of charging by the photosensitive drum 10 and the charging unit 20 installed near the drum, exposure by the laser write unit for each color, and developing by the developing units 41, 42, and 43 is performed three times for the three colors, and a color toner image is formed in the image section of the peripheral surface of the photosensitive drum 10 by superimposing.

Numerals 151 and 152 indicate paths for recording papers which are a transfer material for each size fed from the transfer material feed unit one by one, and 79 indicates a resist roller for conveying the recording paper to the transfer section 160 in synchronization with the movement of the color toner image on the photosensitive drum 10.

Numeral 70 indicates a transfer belt unit, 71 a transfer belt, 72 and 73 rollers which are made of a conductive metallic material, and the roller 72 on the upper stream side is a roller with a rotatable shaft which is grounded or provided with a predetermined potential close to the ground potential, and the roller 73 on the lower stream side is a roller with a fixed shaft for driving the transfer belt 71. Numeral 74 indicates a belt support member. One end thereof is connected to the shaft center (fixed shaft) of the roller 73 and the other end to the moving shaft of the roller 72, and the support is forced by an elastic member which is not shown in the figure so that the roller 72 is positioned down. Therefore, the transfer belt 71 is kept away from the peripheral surface of the photosensitive drum 10 in the normal state. During image transfer, the belt support member 74 is pressed upward in the figure by an eccentric cam 177, which is operated under control of the equipment control unit, via a plate spring 178, and rotated counterclockwise round the roller 73. Rollers 176 installed at both side ends of the belt support member 74 touch the side ends outside the image section of the peripheral surface of the photosensitive drum 10, and the transfer belt 71 touches the transfer section 160 of the photosensitive drum 10.

Numeral 179 indicates a cleaning blade for scraping and cleaning toner attached to the transfer belt 71, and 195 a toner conveying tube with a flexible conveying screw built-in which conveys toner scraped off by the cleaning blade 179 to a toner collection box which is not shown in the figure.

Numeral 16 indicates a transfer charging unit located opposite to the transfer section 160, and 60 a corona discharger with an opening which is opposite to the transfer belt 71 at the location which is opposite to the roller 72 in the wedge-shaped section space between the transfer belt 71 and the photosensitive drum 10.

After the development by the developing unit 43 containing a toner of the third color is started on the photosensitive drum 10 as mentioned above, the operation of the resist roller 79, the contact of the transfer belt unit 70, and the high-voltage application to the discharge wires by the corona discharger 60 are performed almost simultaneously.

By doing this, the corona discharger 60 discharges corona to each recording paper which is fed one by one from the transfer material feed unit to charge it with the same polarity as that of the toner on the photosensitive drum 10. The corona discharger 60 charges the recording paper efficiently and surely using the roller 72, which is almost in the grounded state, as an opposite electrode, and the charge is decreased little during conveying because the corona discharger is installed extremely close to the transfer section 160, and the recording paper is securely attracted to the transfer belt 71 and conveyed to the transfer section 160.

When the head of the recording paper reaches the transfer section 160, the recording paper is pressed against the photosensitive drum 10 by the transfer belt 71. The transfer charging unit 16 charges the recording paper with a polarity reverse to that of the charge of the toner on the photosensitive drum 10 to transfer the toner image onto the recording paper. The recording paper, which is transferred with the toner image, is conveyed to a fixing unit, which is not shown in the figure, by the transfer belt 71, the toner image is fixed to the recording paper by heating and melting, and then the recording paper is ejected into an external pan. Numeral 155 indicates a pawl for preventing the recording paper from moving up by mistake.

Figure 3:
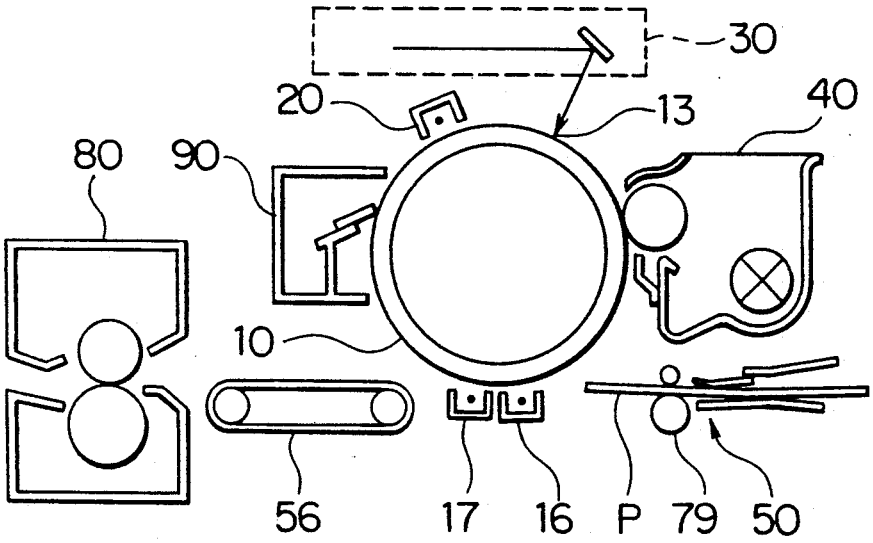
FIG. 3 is a sectional schematic view showing the configuration of a conventional electrophotographic copying machine.
Figure 7:
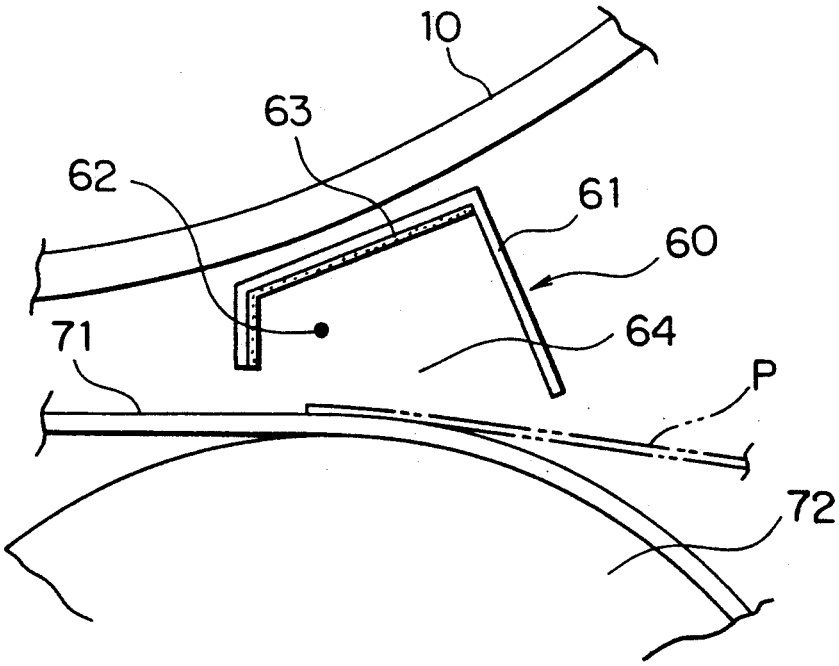
FIG. 7 is a sectional schematic view of the corona discharger and its vicinity shown in FIG. 5.

FIG. 7 is a sectional schematic view of the corona discharger 60 and its vicinity shown in FIG. 5. In the figure, numeral 61 indicates a back plate comprising a stainless steel plate, surface treated steel plate, or aluminum plate of the corona discharger 60 for shielding and forming a stable electric field, and the opening 64 thereof is installed opposite to the transfer belt 71. Numeral 62 indicates discharge wires comprising tungsten wires 60 to 100 microns in diameter. The back plate 61 forms a stable electric field during the charging operation of the corona discharger 60 to stabilize the corona discharge, and prevents unnecessary parts from being charged. During the charging operation, the discharge wires 62 are applied with 5 to 6 kV. If the distance between the discharge wires 62 and the bare back plate 61 is less than about 6 mm, a spark discharge may occur, causing no charging operation. Therefore, this embodiment forms an insulating layer 63 on the inner wall of the back plate 61 on the photosensitive drum 10 side by attaching, for example, a polyester resin tape to prevent a spark discharge when the discharge wires 62 come near the back plate 61. The back plate 61 has, for example, a L-shaped section as shown in FIG. 3 so that it is suited to an installation space with a wedge-shaped section, and can be made smaller. As a result, the corona discharger 60 can be installed extremely close to the transfer section 160.

The corona discharger 60 is installed opposite to the roller 72, discharges corona to the recording paper P fed by the resist roller 79, and charges the recording paper efficiently and surely using the roller 72, which is almost in the grounded state, as an opposite electrode. Furthermore, since the distance between the corona discharger and the transfer section 160 can be extremely shortened, the transfer belt 71 can securely hold and convey the recording paper P, and the separability of the recording paper P from the photosensitive drum 10 after image transfer can be always kept satisfactory.

The transfer belt 71 used as a transfer means comprises, for example, two layers; that is, the base layer thereof is a silicone rubber, polyurethane rubber, or butyl rubber endless sheet with a thickness of 0.5 to 1 mm and a volume resistivity of about $10^{10}$ ohm cm (high) and the upper layer thereof is a fluorocarbon resin film which is sprayed on the base layer to decrease the abrasion resistance.

The discharge wires 62 of the corona discharger 60 are applied with a high voltage with the same polarity as that of the toner (developer) to charge the recording paper P with the same polarity as that of the toner. Therefore, the toner on the photosensitive drum 10 is not attracted by the recording paper P before the recording paper P reaches the transfer section 160, and clearly copied image quality can be obtained because images are not diffused or bled.

The above applied high voltage is controlled so that a discharge current of 20 to 50 $\mu$A is obtained when the moving linear velocity of the peripheral surface of the photosensitive drum 10 is 140 mm/sec, the image width is 300 to 350 mm, and the paper weight is 65 g/m$^2$. In this case, the current component running in the direction of the recording paper P is 10 to 20 $\mu$A when the humidity is high or 5 to 10 $\mu$A when the humidity is low.

The electrode of the transfer charging unit 16 is applied with a high voltage with a polarity reverse to that of the toner charge under the constant current control when the head of the recording paper P slightly passes through the transfer section 160 to transfer the toner image. This constant current control switches the current to 350 $\mu$A when the humidity is high or to 200 $\mu$A when the humidity is low for charging.

By doing this, the charge current can be varied according to a change of the humidity which produces a great effect, and a satisfactory attraction and transfer efficiency can be kept.

The photosensitive drum 10, which finishes image transfer, is cleaned by the cleaning unit 90 which comprises a cleaning blade 91 and a toner collection roller for electrostatically collecting residual toner. While a toner image is being formed on the peripheral surface of the photosensitive drum 10, the cleaning blade 91 is in the standby state. When the image transfer is finished, the cleaning blade is pressed against the photosensitive drum 10 for cleaning. A static eliminator lamp 93 is installed on the upper stream side of the cleaning unit 90, and a static eliminator lamp 94 on the lower stream side. The static eliminator lamp 93 eliminates static electricity from residual toner on the peripheral surface of the photosensitive drum 10 so that it can be easily removed, and the static eliminator lamp 94 eliminates static electricity uniformly from the cleaned peripheral surface of the photosensitive drum 10 so that it can be uniformly charged. A toner conveying tube 95 with a toner conveying screw which is made of a flexible material is installed at the bottom of the cleaning unit 90 to convey waste toner collected by cleaning to a toner collection box which is not shown in the figure. The photosensitive drum 10, which finishes cleaning, goes to the next image forming process.

Figure 8:
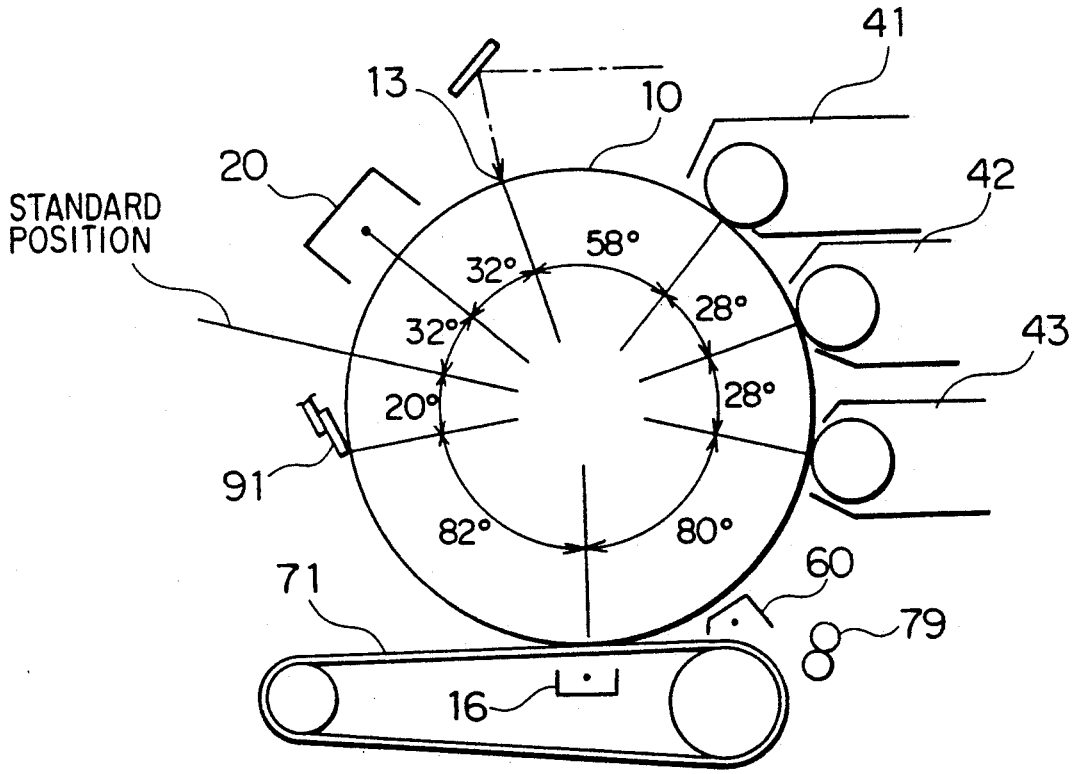
FIG. 8 is an illustration showing the layout relations of the units of the above image forming device.
Figure 9:
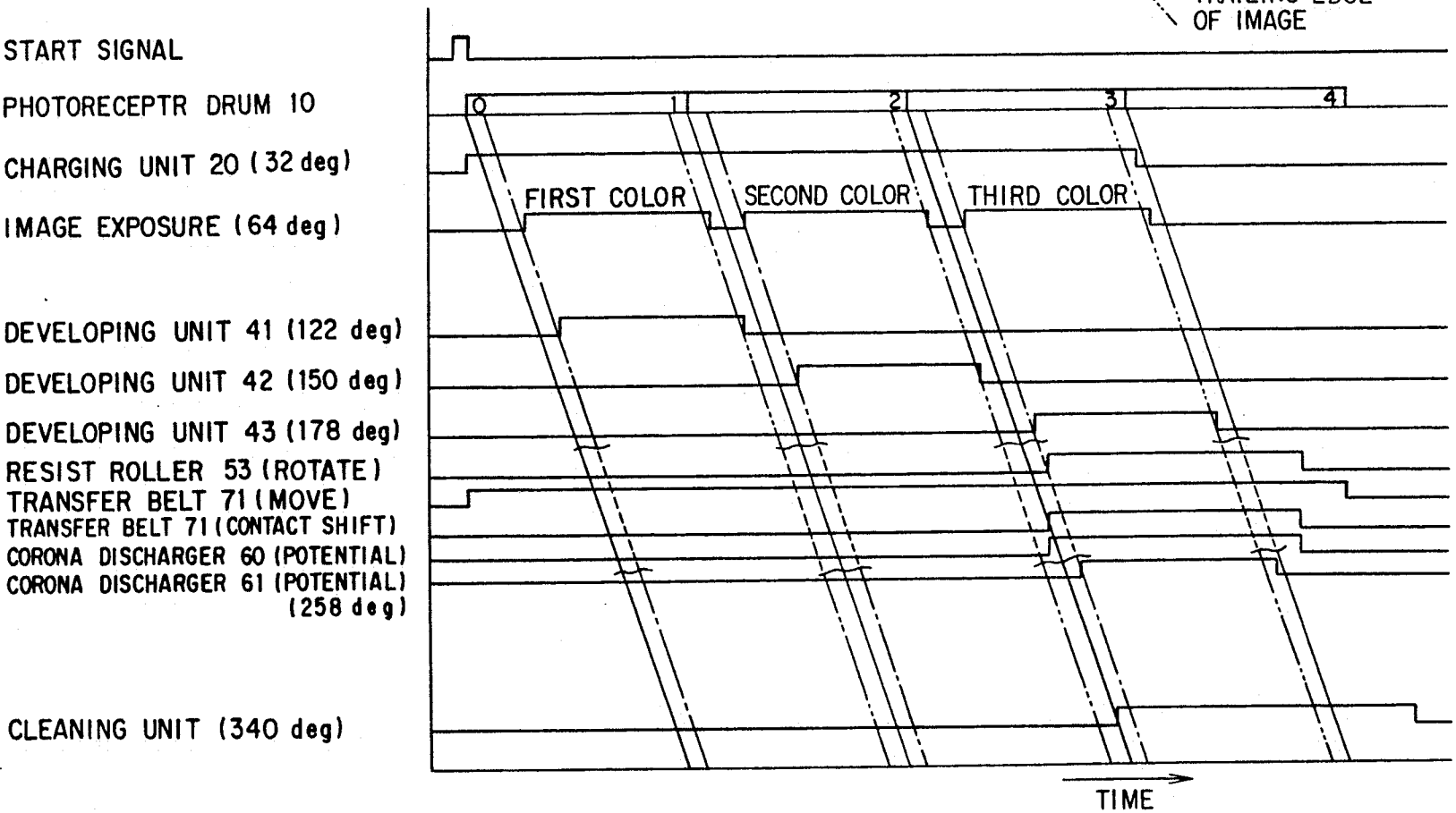
FIG. 9 shows a timing chart for image forming in the above layout relations.

The color image forming device shown in FIG. 5, which is described above, comprises image forming means which are installed around the photosensitive drum 10 as shown in FIG. 8. As shown in the timing chart in FIG. 9, a control unit installed in the main unit of the image forming device controls the sequence to form color images.

The configuration of this embodiment permits the corona discharger of the transfer belt unit to be installed extremely close to the transfer section. Therefore, the transfer belt of this device has a superior attraction and conveying force against the recording paper in a highly humid environment, and a color image forming device which permits smooth paper conveying and superior toner image transfer can be provided.

Figure 10:
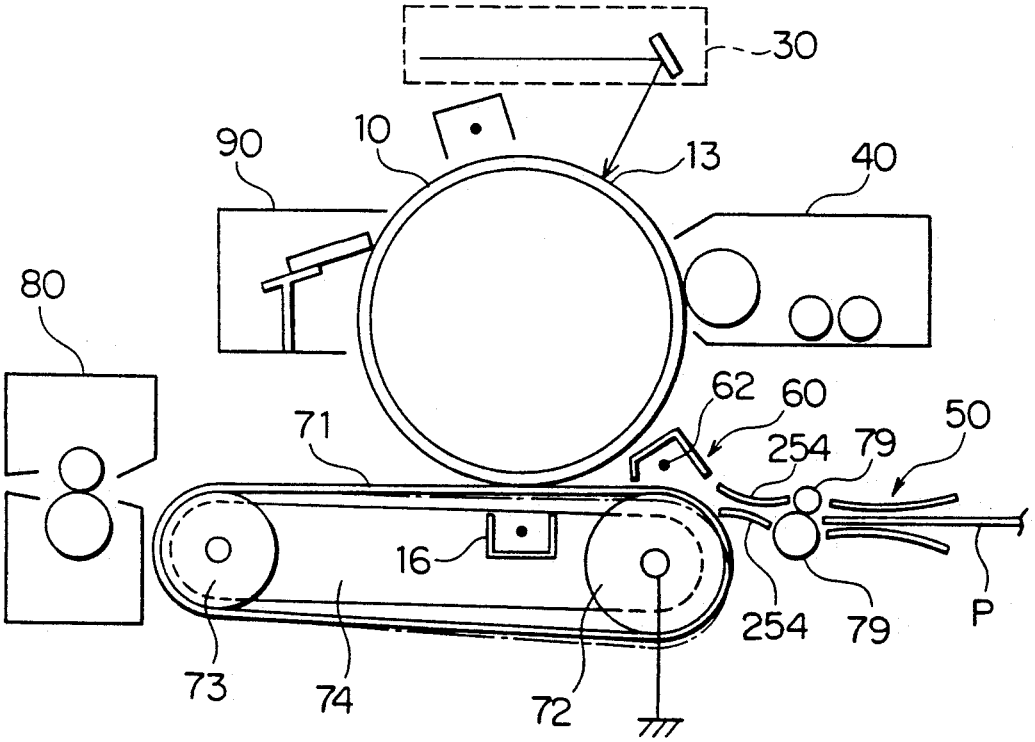
FIG. 10 is a schematic view of the third embodiment of the transfer belt unit of the present invention.

FIG. 10 is a sectional schematic view of the third embodiment of an image forming device of the present invention.

The parts in the figure which are the same as those of the conventional image forming device and the transfer belt unit 70*a* shown in FIGS. 3 and 4 are expressed by the same numerals, and duplicated detailed descriptions thereof are omitted because the operations thereof are almost similar. Numeral 254 indicates guide plates installed between paper feed rollers 79 of a paper feed unit 50 and a roller 72, and 70 a transfer belt unit. The rollers 72 and 73 of the transfer belt unit 70 are made of a conductive metallic material, and the roller 72 on the upper stream side is grounded or provided with a predetermined potential close to the grounded status. Numeral 74 indicates a roller support member. One end thereof is connected to the shaft center (fixed shaft) of the roller 73 and the other end to the moving shaft of the roller 72, and the support is forced by an elastic member which is not shown in the figure so that the roller 72 is positioned down. Therefore, the transfer belt 71 is kept away from the peripheral surface of the photosensitive drum 10 in the normal state as shown by an alternate long and short dash line. During image transfer, the roller support member 74 is rotated counterclockwise, for example, by a solenoid or a motor which is operated under control of the equipment control unit, and the transfer belt 71 is pressed against the photosensitive drum 10. The guide plates 254 may be eliminated by installing the paper feed rollers 79 close to the roller 72.

The transfer belt 71 used as a transfer means comprises, for example, two layers; that is, the base layer thereof is a silicone rubber, polyurethane rubber, or butyl rubber endless sheet with a thickness of 0.5 to 1 mm and a volume resistivity of about $10^{10}$ ohm.cm (high) and the upper layer thereof is a fluorocarbon resin film which is sprayed on the base layer to decrease the abrasion resistance.

Figure 11:
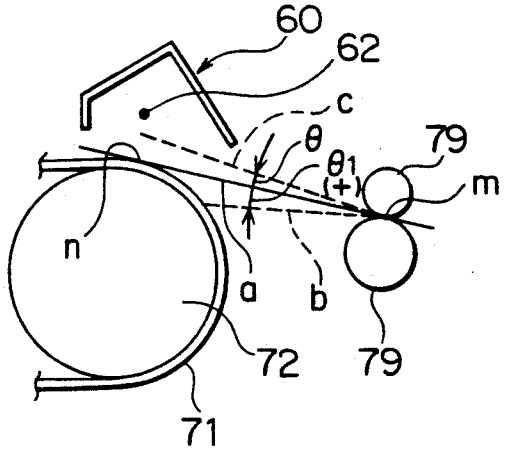
FIG. 11 is an enlarged sectional view of the corona discharger and its vicinity shown in FIG. 1.

FIG. 11 is an enlarged sectional view of the corona discharger 60 and its vicinity shown in FIG. 10, and the guide plates 254 are omitted. In the figure, numeral 62 indicates a corona discharger, 60 a discharge electrode, "m" a common contact point between the paper feed rollers 79, "n" a contact point of a tangential line "a"

drawn from the common contact point "m" onto the transfer belt 71 of the roller 72, "b" a prolonged line of the common tangential line of the paper feed rollers 79, $\theta_1$ an angle between the tangential line "a" and the common tangential line "b", and $\theta$ an angle between the tangential line "a" and a straight line "c" connecting the head of a recording paper P, which enters into the effective discharge region of the corona discharger 60, and the common contact point "m". $\theta_1$ and $\theta$ are positive (+) when they are below the tangential line "a" or negative (−) when they are above the tangential line "a".

Simultaneously with the start of rotation of the paper feed rollers 79, the transfer belt unit 70 drives and presses the transfer belt 71 against the photosensitive drum 10, and the corona discharger 60 is applied with a high voltage for charging, and the head of the recording paper P is sent into the effective discharge region of the corona discharger 60 by the paper feed rollers 79.

Figure 12:
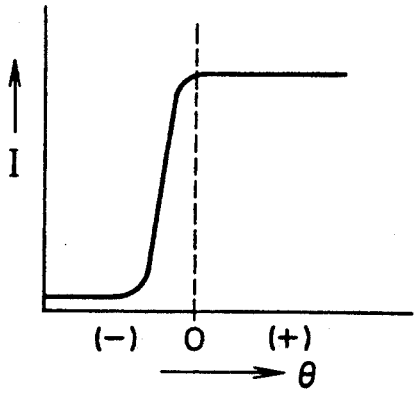
FIG. 12 is a graph showing the relations between the position of the head of a recording paper and the charge current of the corona discharger.

FIG. 12 shows the experimental results of relations between the angle $\theta$ of the straight line "c" connecting the head of the recording paper P, which enters into the above effective discharge region, and the common contact point "m" and the charge current I flowing through the recording paper P (especially the head thereof). The graph shows that if the head of the recording paper P is apart from transfer belt 71 when it enters into the discharge region, the discharge current I decreases and the attraction between the transfer belt 71 and the recording paper P also decreases. Therefore, it is important that the recording paper P is fed by the paper feed rollers 79 so that the value of $\theta$ is positive (+). In other words, it is preferable that the leading edge of the recording paper contacts the surface of the transfer belt before it enters into the discharge region. Since the present invention sets that the prolonged line of the recording paper P in the paper feed direction by the paper feed rollers 79 at the end of the paper feed means or by the guide plates 254 which are not shown in the figure is below the the tangential line "a", the head of the recording paper P is securely charged and powerfully attracted to the transfer belt 71.

The corona discharger 60 is installed opposite to the roller 72, discharges corona to the recording paper P fed by the paper feed unit 50, and charges the recording paper efficiently and surely using the roller 72, which is almost in the grounded state, as an opposite electrode. Furthermore, since the distance between the corona discharger and the transfer section 160 can be extremely shortened, the transfer belt 71 can securely hold and convey the recording paper P, the head of the recording paper P is kept securely attracted to the transfer belt 71 after transfer, the separability of the recording paper P after image transfer can be kept satisfactory, free of paper jamming due to attraction by the photosensitive drum 10, and the recording paper can be smoothly fed.

The discharge electrode 62 of the corona discharger 60 is applied with a high voltage with the same polarity as that of the toner (developer). Therefore, the toner on the photosensitive drum 10 is not attracted by the recording paper P before the recording paper P reaches the transfer section 160, providing clearly copied image quality.

The above high voltage applied to the corona discharger 60 for charge is controlled so that a discharge current of 20 to 50 $\mu$A is obtained when the moving linear velocity of the peripheral surface of the photosensitive drum 10 is 140 mm/sec, the image width is 300 to 350 mm, and the paper weight is 65 g/m$^2$. In this case, the current component running in the direction of the recording paper P is 10 to 20 $\mu$A when the humidity is high or 5 to 10 $\mu$A when the humidity is low.

The transfer unit 16 is applied with a high voltage with a polarity reverse to that of the toner charge under the constant current control when the head of the recording paper P passes through the transfer section 160 to transfer the toner image. This constant current control switches the current to 350 $\mu$A when the humidity is high or to 200 $\mu$A when the humidity is low for charging. Therefore, the head of the recording paper P is kept attracted to the transfer belt 21 after image transfer, and the charge current can be varied according to a change of the humidity which produces a great effect so as to keep a fixed range of attraction and transfer efficiency, and an attraction and conveying force, which is always kept constant and secure without being affected by the environment, and a high transfer efficiency can be obtained, and the recording paper can be smoothly conveyed.

The configuration of this embodiment provides an image forming device which is characterized in that a transfer belt has a superior attraction and conveying force to recording paper, especially the head thereof, the separability of recording paper from an image carrier member is good, and the paper feedability is extremely satisfactory.

What is claimed is:

1. A transfer belt unit for use in an image forming apparatus for conveying a recording sheet and for transferring a toner image from an image carrying drum onto the recording sheet, comprising:

a conveyor belt stretched between an inlet roller and an outlet roller for transferring the recording sheet in a conveying direction from the inlet roller to the outlet roller, said inlet roller being made of an electrically conductive material, wherein a surface of the conveyor belt is adapted to contact the image carrying drum at a contact location to form a wedge shaped space between surfaces of the conveyor belt and the image carrying drum, the wedge shaped space being smallest adjacent the contact location;

corona discharging means facing a rear surface of the conveyor belt at the contact location for transferring the toner image from the image carrying drum to the recording sheet; and preliminary corona discharging means located in the wedge shaped space over the inlet roller and facing the inlet roller for charging the recording sheet as it passes through a discharging zone formed between the inlet roller and the preliminary corona discharging means, the recording sheet being charged by corona discharge, thereby generating an electric force to cause the recording sheet to be attracted to the surface of the conveyor belt, wherein the preliminary corona discharging means comprises:

a discharging electrode, and a shield plate having an outer profile of a trapezium fitted to be located in the wedge shaped space with a smaller dimension portion of the trapezium shaped shield plate located closest to the contact location for restricting a discharging zone of the recording sheet close to the contact location, said shield plate partially enclosing the electrode and having an opening facing the surface of the conveyer belt and facing said inlet roller such that the electrode faces the surface of the conveyor belt and faces said inlet roller through said opening, thereby forming a charging zone of the recording sheet close to the contact location;

feed means located upstream of the inlet roller in the conveying direction for feeding the recording sheet to the inlet roller; and guide means located between the feed means and the inlet roller for guiding the recording sheet such that the leading edge of the recording sheet contacts the conveyor belt before the leading edge of the recording sheet enters into the discharging zone.

2. The transfer belt unit of claim 1, wherein the inner surface of the shield plate is coated with an insulating layer, and the distance between the electrode and the inner surface of the shield plate is such that sparking between the electrode and the shield plate is prevented.

3. The transfer belt unit of claim 1, wherein:

feed means located upstream of the inlet roller in the conveying direction of the recording sheet includes means for feeding the recording sheet to the conveyor belt; and said feed means feeding the recording sheet in a manner such that the leading edge of the recording sheet contacts the conveyor belt before the recording sheet enters into the discharging zone.

4. The transfer belt unit of claim 1, wherein the conveyor belt comprises a layer made of a rubber selected from the group of silicone rubber, polyurethane rubber and butyl rubber.

5. The transfer belt unit of claim 4, wherein the conveyer belt further comprises a second layer on said rubber layer for decreasing abrasion resistance.

6. The transfer belt unit of claim 5, wherein said second layer comprises a fluorocarbon resin film.

7. The transfer belt unit of claim 4, wherein said conveyor belt is an endless belt.

8. The transfer belt unit of claim 1, wherein said conveyor belt is an endless belt.

9. The transfer belt unit of claim 1, wherein the inlet roller is at substantially ground potential.

10. The transfer belt unit of claim 1, wherein the shield plate is made of a material selected from the group consisting of stainless steel, surface treated steel and aluminum.

11. The transfer belt unit of claim 1, wherein the discharging electrode comprises at least one tungsten wire of 60 to 100 microns in diameter.

12. The transfer belt unit of claim 1, wherein the corona discharging means comprises a constant current controller.

* * * * *